US008075459B2

(12) United States Patent
Axelsson

(10) Patent No.: US 8,075,459 B2
(45) Date of Patent: Dec. 13, 2011

(54) ADJUSTMENT DEVICE FOR A TRAINING MACHINE

(75) Inventor: Kjell Axelsson, Lidkoping (SE)

(73) Assignee: Mats Thulin, Lidingo (SE)

( * ) Notice: Subject to any disclaimer, the term of this patent is extended or adjusted under 35 U.S.C. 154(b) by 0 days.

(21) Appl. No.: 12/720,885

(22) Filed: Mar. 10, 2010

(65) Prior Publication Data

US 2010/0234190 A1 Sep. 16, 2010

(30) Foreign Application Priority Data

Mar. 10, 2009 (SE) ..... 0950138

(51) Int. Cl.
*A63B 21/062* (2006.01)

(52) U.S. Cl. ..... 482/100; 482/92; 482/136

(58) Field of Classification Search ..... 482/92–104, 482/136–139, 142, 907
See application file for complete search history.

(56) References Cited

U.S. PATENT DOCUMENTS

| | | | | |
|---|---|---|---|---|
| 4,629,185 | A * | 12/1986 | Amann | 482/113 |
| 5,026,049 | A * | 6/1991 | Goodman | 482/131 |
| 5,277,681 | A * | 1/1994 | Holt | 482/112 |
| 5,580,341 | A * | 12/1996 | Simonson | 482/100 |
| 5,643,152 | A * | 7/1997 | Simonson | 482/100 |
| 5,904,641 | A * | 5/1999 | Huang | 482/131 |
| 6,352,495 | B1 * | 3/2002 | Hsu | 482/92 |
| 6,394,936 | B1 * | 5/2002 | Voris | 482/100 |
| 6,394,937 | B1 * | 5/2002 | Voris | 482/139 |
| 6,471,624 | B1 * | 10/2002 | Voris | 482/142 |
| 6,579,213 | B1 * | 6/2003 | Webber et al. | 482/100 |
| 6,988,977 | B2 * | 1/2006 | Webber et al. | 482/100 |
| 7,322,906 | B2 * | 1/2008 | Webber | 482/100 |
| 7,384,381 | B2 * | 6/2008 | Webber et al. | 482/100 |
| 7,393,310 | B2 * | 7/2008 | Andrews | 482/131 |
| 7,563,214 | B2 * | 7/2009 | Webber et al. | 482/135 |
| 7,597,655 | B2 * | 10/2009 | Webber et al. | 482/136 |
| 7,601,108 | B2 * | 10/2009 | Andrews | 482/131 |
| 7,666,123 | B2 * | 2/2010 | Giannelli | 482/100 |

(Continued)

FOREIGN PATENT DOCUMENTS

DE 20106878 U1 7/2001

OTHER PUBLICATIONS

European Search Report in Corresponding Application No. EP 10155151 Date Jun. 22, 2010.

*Primary Examiner* — Loan Thanh
*Assistant Examiner* — Daniel Roland
(74) *Attorney, Agent, or Firm* — Young & Thompson

(57) ABSTRACT

The present invention relates to an adjustment device (2) for a training machine (1), especially a triceps extension or a biceps curl, for strengthen training and rehabilitation, having an arm or elbow rest member (50, 51) and pivotably connected handles (23, 24) are provided on each side of a seat (17). Furthermore, the arm or elbow rest members (50, 51) as well as the handles (23, 24) are provided at the lower ends of at both sides of the seat arranged arms (18, 19) pivotably suspended at a position at the top of the training machine (1). Moreover, the adjustment device (2) includes control element (41, 42, 48, 49) for laterally adjusting the positions of the arms and in turn also the arm or elbow rest members (18, 19) as well as the handles (23, 24).

14 Claims, 7 Drawing Sheets

U.S. PATENT DOCUMENTS

| | | | | |
|---|---|---|---|---|
| 7,811,211 | B2 * | 10/2010 | Habing | 482/100 |
| 7,833,138 | B1 * | 11/2010 | Fulks | 482/97 |
| 7,922,630 | B1 * | 4/2011 | Batca | 482/94 |
| 2002/0198087 | A1 | 12/2002 | Mitchell et al. | |
| 2003/0092543 | A1 * | 5/2003 | Giannelli | 482/100 |
| 2003/0100413 | A1 * | 5/2003 | Huang | 482/100 |
| 2003/0195091 | A1 * | 10/2003 | Webber et al. | 482/100 |
| 2006/0258517 | A1 * | 11/2006 | Ashley | 482/94 |
| 2007/0093364 | A1 * | 4/2007 | Batca | 482/99 |
| 2007/0249474 | A1 * | 10/2007 | Webber et al. | 482/93 |
| 2008/0171643 | A1 * | 7/2008 | Baudhuin | 482/148 |

* cited by examiner

ADJUSTMENT DEVICE FOR A TRAINING MACHINE

TECHNICAL FIELD

The present invention is related to an adjustment device for a training machine, especially a triceps extension or a biceps curl, for strengthen training and rehabilitation of the kind which is defined in the pre-characterising portion of claim 1.

BACKGROUND OF THE INVENTION

The training machine known as triceps extension has handles which are to be gripped by the user when exercising. The general triceps extension machine has a weight stack with weights whereas the user selects a weight package to be lifted, normally consisting of a selected number of weights from the top of the package. The selected weights are then lifted by means of a non-elastic wire or belt when the user draws the handles of the machine towards his body.

Such a triceps extension machine is, e.g., disclosed in US 2002/0198087 and U.S. Pat. No. 5,897,467. These known triceps extension machines do not take the body structure of the user in consideration, i.e., the width across the shoulders is varying from person to person so that when a weight package of a weight stack is lifted or lowered, the user often must bend wrist or elbow to be able to perform the exercise.

OBJECT OF THE INVENTION

The object of the present invention is to provide an adjustment device for a training machine of the type mentioned above which sets aside the above mentioned problem.

SUMMARY OF THE INVENTION

The object is achieved by means of an adjustment device for a training machine having the characteristics defined in the characterising portion of claim 1.

Preferred embodiments of the invention have been given the characteristics which are apparent in the sub claims.

When a person lowers and lifts a selected number of weights of a weight package, the person performing the exercise can adjust the position of the handles laterally, which makes the exercise movement more comfortable and does not end in injuries due to unnatural bending stresses.

BRIEF DESCRIPTION OF THE DRAWINGS

The invention is described in the following with reference to the appended drawings showing a preferred embodiment.

DESCRIPTION OF A PREFERRED EMBODIMENT OF THE INVENTION

Figure 1:
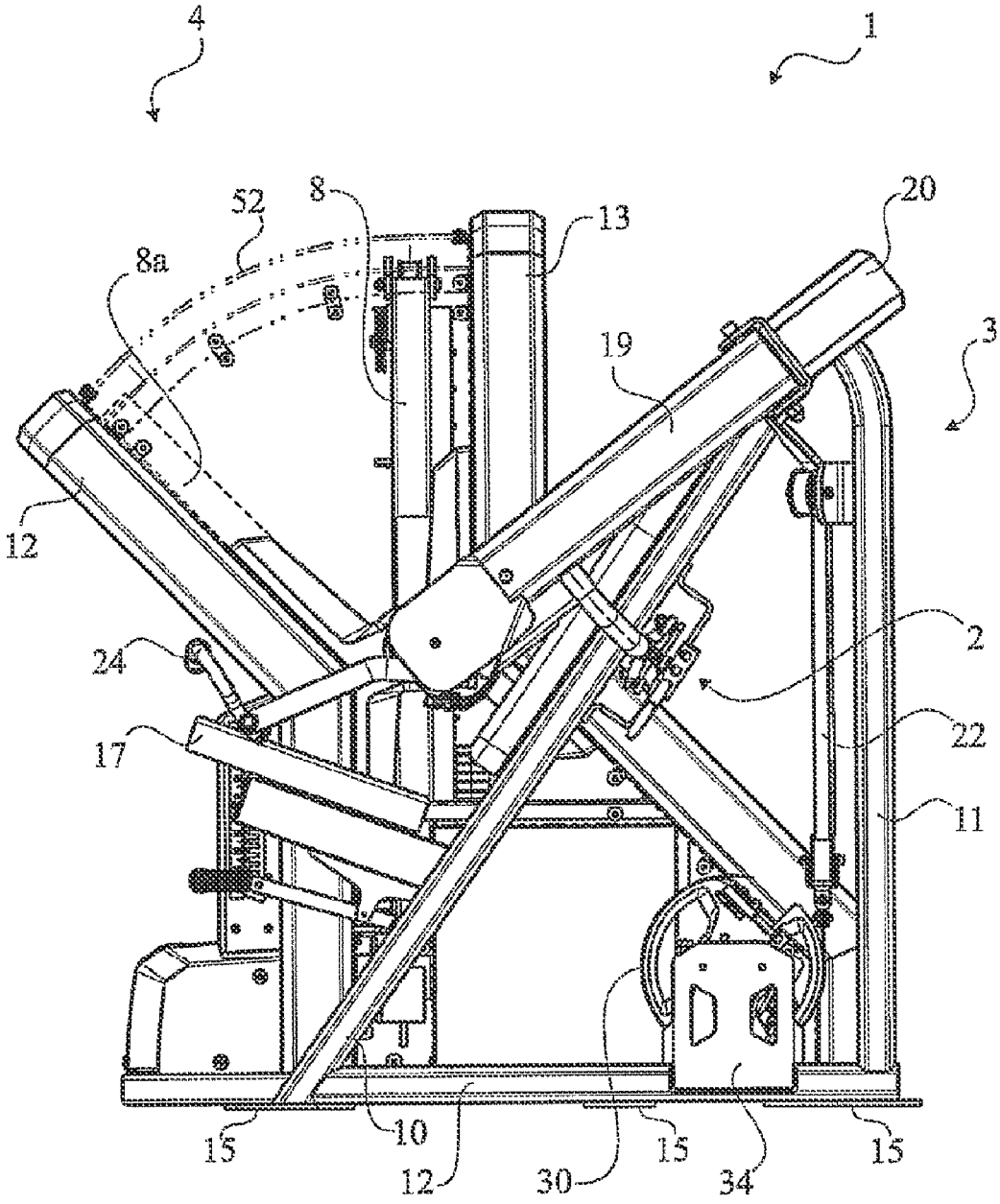
FIG. 1 shows a side view of a training machine for strength training and rehabilitation with an adjustment device according to the invention.
Figure 2:
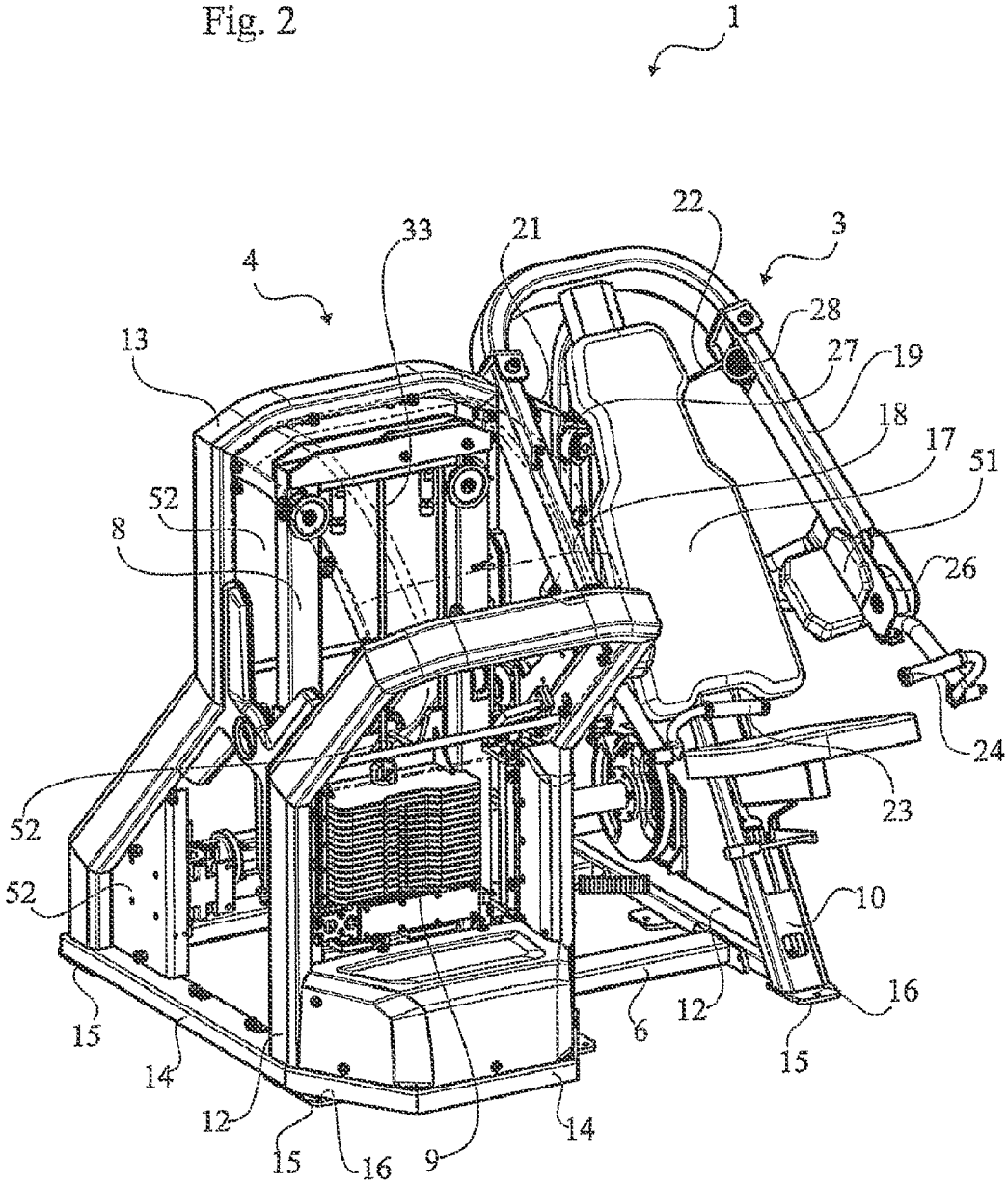
FIG. 2 shows a perspective view from above of the training machine in FIG. 1.
Figure 3:
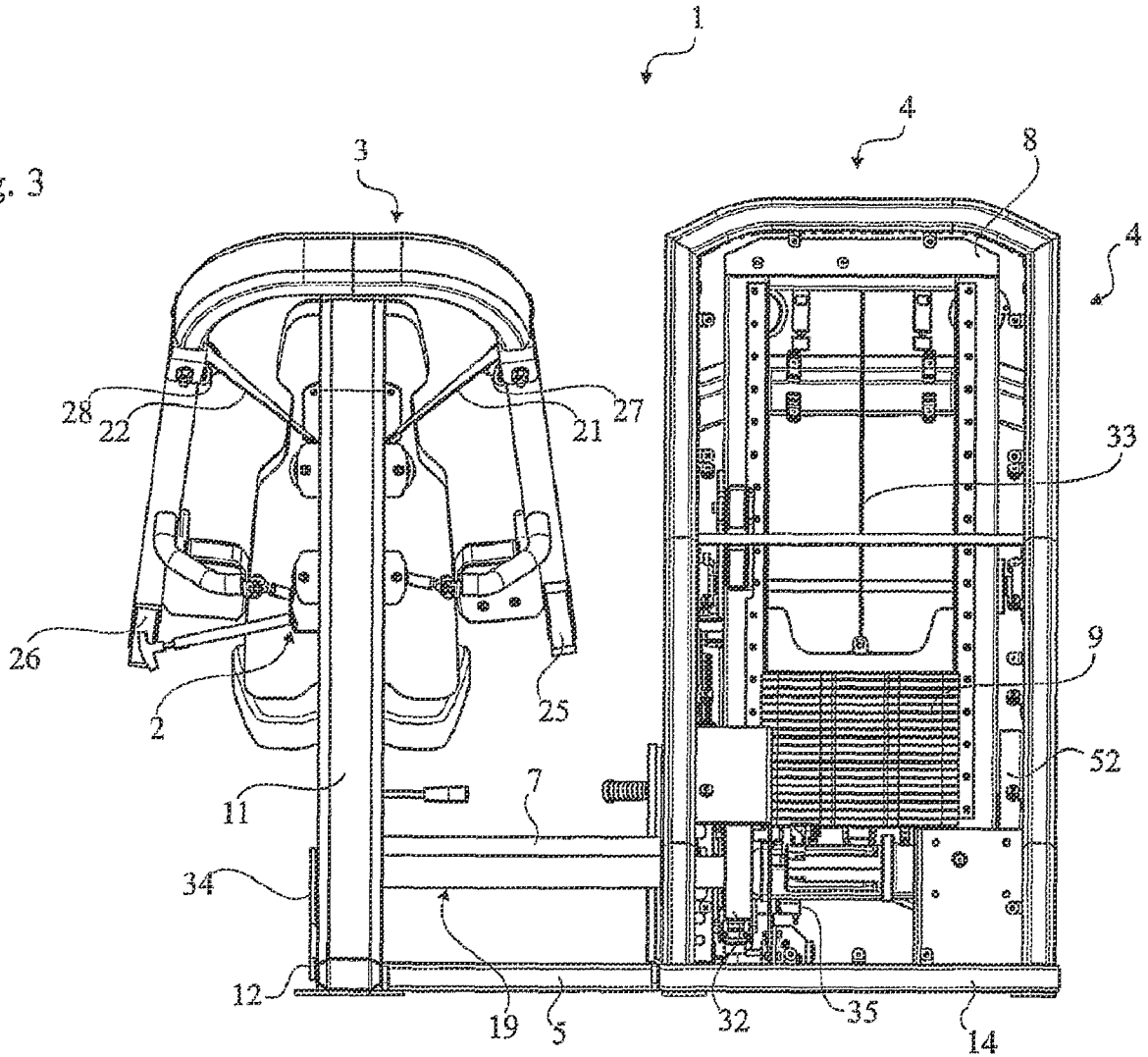
FIG. 3 shows a view from behind of the training machine in FIG. 1.
Figure 4:
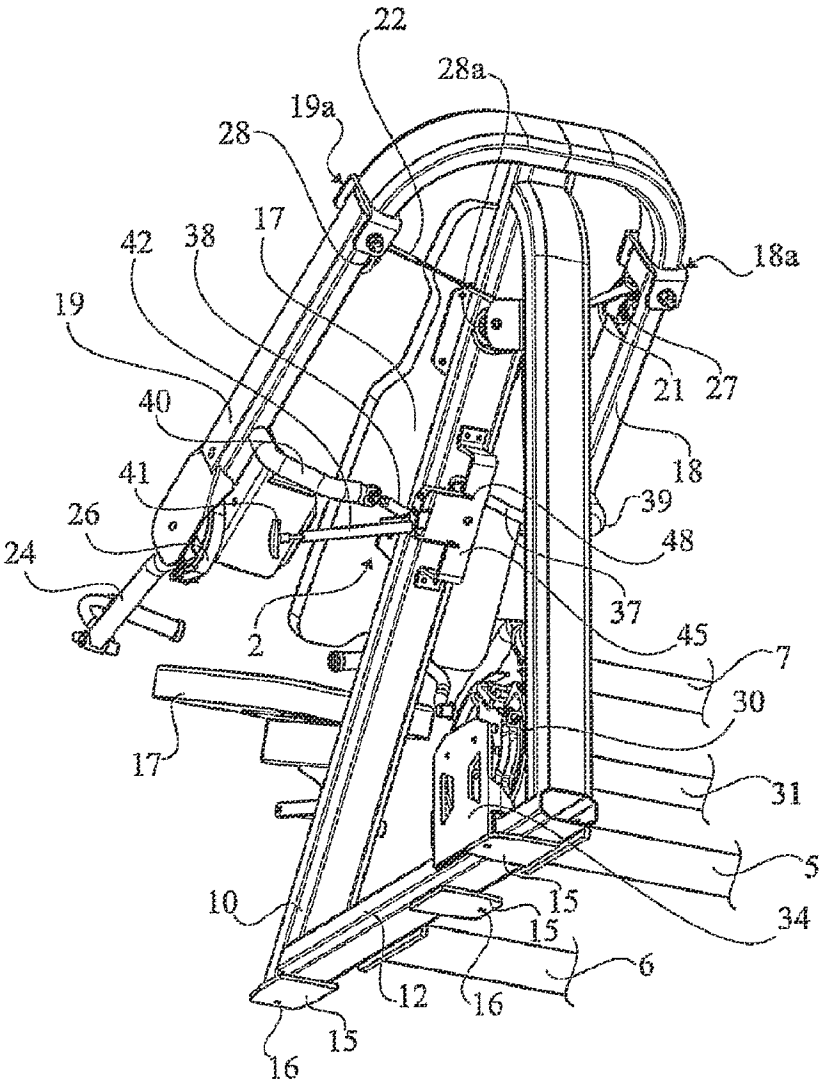
FIG. 4 shows a perspective view from below of the training section of the training machine illustrating the adjustment device according to the invention in one position.
Figure 5:
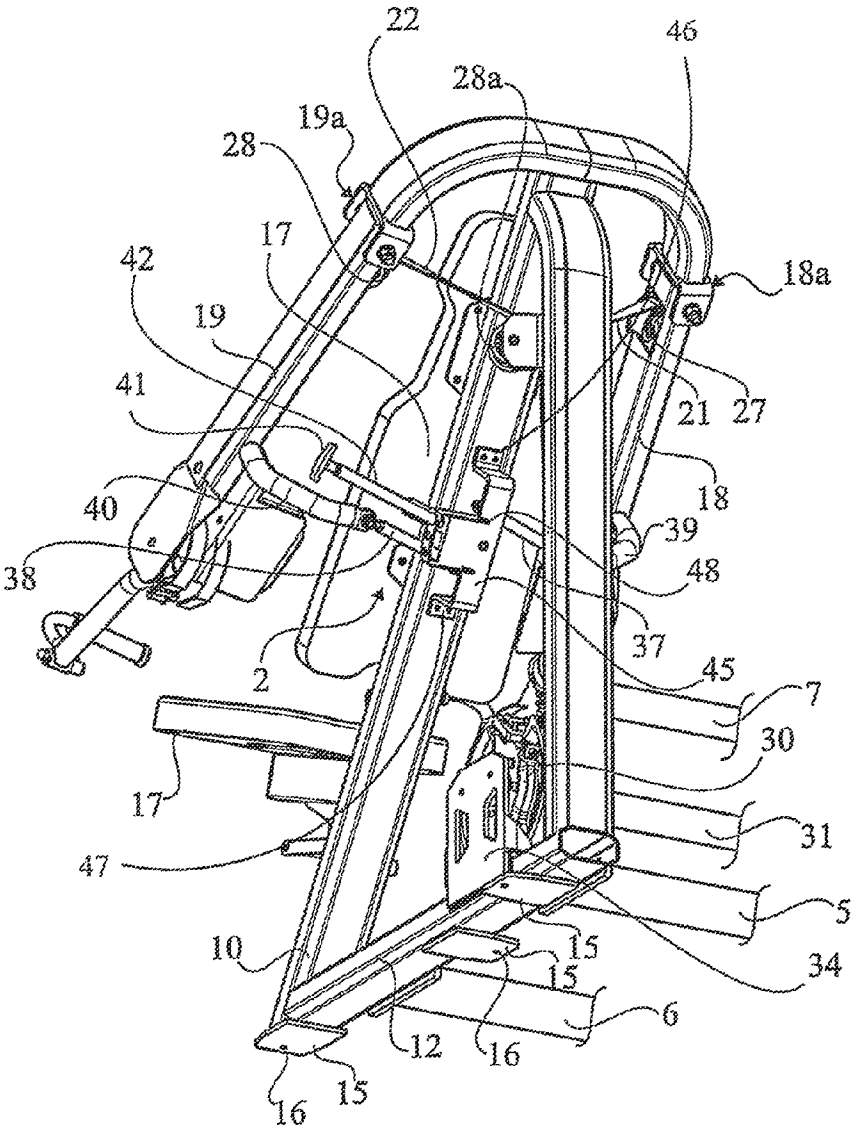
FIG. 5 shows a perspective view similar to FIG. 4 illustrating the adjustment device according to the invention in another position.
Figure 6:
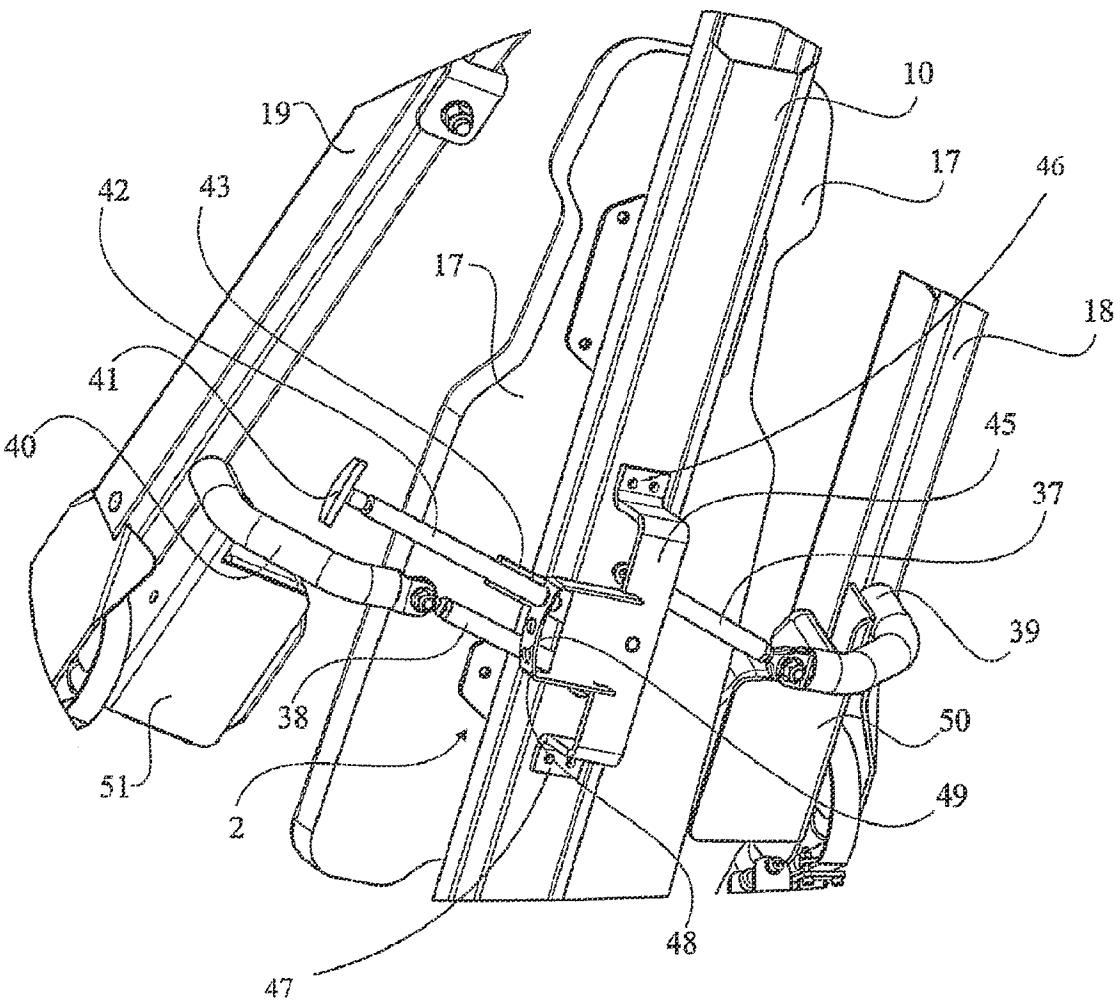
FIG. 6 shows a partial perspective view in greater scale of a detail of the training machine in said another position according to FIG. 5.
Figure 7:
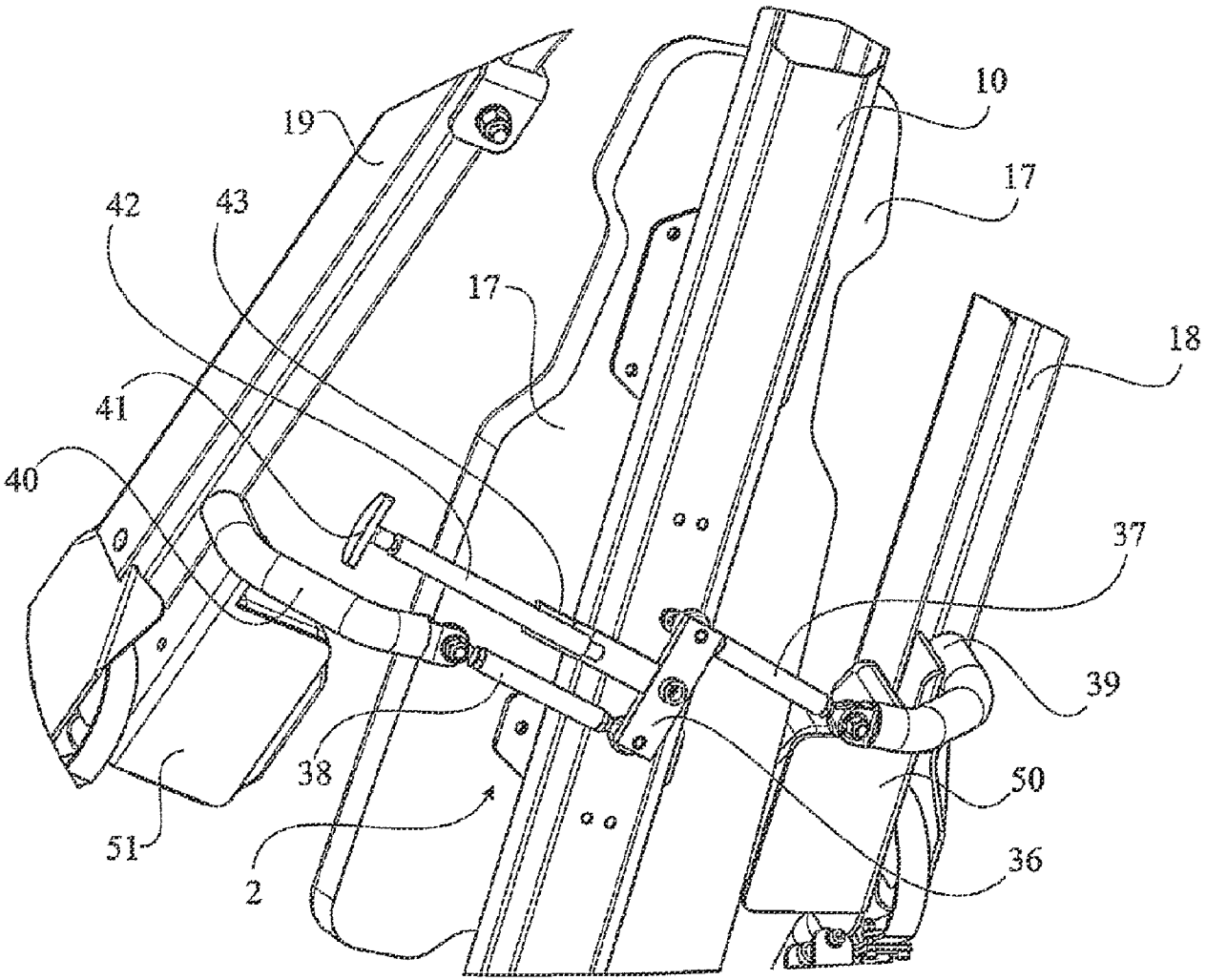
FIG. 7 shows a partial perspective view similar to FIG. 6 but with a part removed for clarity reasons.

In FIGS. 1-7 a preferred embodiment of a training machine 1, especially a triceps extension, for strength training and rehabilitation with an adjustment device 2 according to the invention is shown. The machine 1 consists of two main sections, viz., a training section 3 and a weight section 4 which are fixed connected to each other by means of horizontal beams 5, 6 and 7 which are fixed to the machine. The weight stack section 4 has an inner substantially rectangular frame portion 8, which is turnably journalled in pivot pins (not shown). The frame portion 8 supports the weight stack 9 and is tiltable from a vertical position as is best seen in FIG. 1 to an inclined position shown with broken lines at 8*a* in FIG. 1. By changing the inclination of the frame the load can be altered for the user as is disclosed in my PCT-patent application WO 2007/037755. The beams 5, 6 and 7 as well as the beams 10, 11, 12, 13 and 14 comprised in the frame construction of the training machine 1, which portions are fixed connected to each other, are advantageously welded to each other to achieve a solid construction, which shall be able to stand high loads concerning pull and press loads as well as vibrations. Base plates 15 are fixed to the lowest beams 10 11, 12, and 14 under the machine 1, said plates being provided with bolt holes 16 for fixing the machine 1 to a floor or the like.

The training section 3 comprises a seat 17 for the user to rest on while exercising, two journally mounted arms 18 and 19 turnably connected at 18*a* and 19*a*, respectively, at the top of the machine to an arcuately formed top beam 20 which is attached to the top of the beam 10, preferably by welding. Non-elastic wire or belts 21 and 22, preferably made by the material Kevlar®, are each fixed to pivotable handles 23 and 24 over pulleys 25 and 26. The belts 21, 22 are lead from the handles 23, 24 around further pulleys 27, 28, 28*a* via an equalization device (not shown) to a transmission device 29.

The transmission device has a disc 30 which is fixed to a shaft 31. At the other end of the shaft 31 a similar disc 32 is fixed to a further non-elastic wire or belt 33, preferably made by the material Kevlar®, which is led over not shown pulleys to the weight stack 8. The discs 30, 32 are journalled in bearings in brackets 34 and 35 which are fixed to the frame 12, 14 of the machine 1.

The adjustment device 2 according to the invention is best shown in FIGS. 4-7 and comprises a central link 36 (se FIG. 7) which is turnably attached to the frame beam 10 at the centre thereof. Link arms 37 and 38 are connected at one end to the each end of the central link 36 and at the opposite ends at arcuate arms 39 and 40 which in turn are rigidly fixed to the arms 18 and 19, respectively. A T-formed handle member 41 is spring-loaded mounted in a tube 42 which is rigidly connected to the central link 36 via a member 43. An adjustment scale holder 45 having a substantial U-form is bolted to the frame beam 10 at 46 and 47 so that it astrides over the link 36. At a central portion of the holder 45 a substantially U-formed scale bracket 48 is fixed having three holes 49 in an arcuate central portion thereof. The holes 49 are so situated that each of them represent a lateral position of the arms 18 and 19 when the tip of the T-formed handle member 41 protruding out of the tube 42, as the spring thereof is released, is introduced into a selected hole. In the drawings, three different positions for the lateral positioning of the arms are shown, but it is evident that the number of positions of the arms can be other within the scope of the claims.

A user of the machine 1, before be seated on the seat chooses the lateral position of the arms 18 and 19 which is best apt to his body structure by means of the handle member 41. The user will then get a comfortable lateral distance between his arm elbows resting on pads 50 and 51 so that he can perform his exercise without bending elbows or wrists. Reference number 49 denotes a selection device to select a desired group of weights of the weight stack 8 to be lifted.

Instead of the T-formed handle member 41 the adjustment device 2 according to the invention could be provided with any other kind of adjustable control means, as, e.g., a knob (not shown) fixed to the central link 36 and having a push bottom which when pressed provides that a pin inside the knob is disengaged from one of the holes in a scale on a member which is fixed to the frame, each hole constituting an adjustable set position of the laterally pivotably arms 18 and 19. When the knob is turned and the push button is released the pin is provided to enter another one of the position holes in the scale.

Reference number 52 denotes shields, preferably made of transparent plastic mounted around the weight section 4 to protect the user or other persons from injuries due to the movement of the frame portion 8 and the weight stack 9.

Although one embodiment is disclosed in the description and drawings, the training machine according to the invention can be modified within the scope of the appended claims.

The invention claimed is:

1. An adjustment device for a training machine, especially a triceps extension or a biceps curl, for strengthen training and rehabilitation, having an arm rest member positioned to contact and rest a user's arm and pivotably connected handles provided on each side of a seat, wherein said arm rest members and said handles are provided at lower ends of arms arranged at both sides of said seat, the arms being pivotably suspended at a position at a top of said training machine such that said adjustment device comprises control means for laterally adjusting positions of said arms, said arm rest members, and said handles with regard to said seat, wherein said adjustment device further comprises a linkage means at each side of said adjustment device, each of said linkage means being connected at one end thereof to a turnable link member, which is pivotably fastened at its center at a frame portion of the training machine, and connected at the other end to said arms.

2. The adjustment device according to claim 1, further comprising a control member which can be set in a selected position of a pre-determined number of positions corresponding to the laterally adjusting positions of said arms, said arm rest members, and said handles.

3. The adjustment device according to claim 1, wherein said arms are pivotably attached at the top of a frame portion of the training machine so that said arms, said arm rest members, and said handles are able to be turned laterally with regard to said seat.

4. The adjustment device according to claim 1, wherein said control means interacts with a scale member attached to the frame of the training machine, such that when turning said control means, a desired position on the scale member can be set.

5. The adjustment device according to claim 4, wherein said control means comprises a T-formed shaft which is spring-loaded within a tube, said shaft engageable with said scale member.

6. The adjustment device according to claim 4, wherein each of said laterally adjusted positions of said arms is a hole provided in said scale member which is fixed to a frame portion of the training machine.

7. The adjustment device according to claim 2, wherein said arms are pivotably attached at the top of a frame portion of the training machine so that said arms are able to be turned laterally.

8. The adjustment device according to claim 2, wherein said control means interacts with a scale member attached to the frame of the training machine, such that when turning said control means a desired position on the scale member can be set.

9. The adjustment device according to claim 3, wherein said control means interacts with a scale member attached to the frame of the training machine, such that when turning said control means a desired position on the scale member can be set.

10. The adjustment device according to claim 5, wherein at each of said laterally adjusted positions of said arms is a hole provided in said scale member which is fixed to a frame portion of the training machine.

11. The adjustment device according to claim 1, wherein said arm rest members include pads to contact both the user's arms and elbows.

12. An adjustment device for a training machine, especially a triceps extension or a biceps curl, for strengthen training and rehabilitation, having an arm rest member positioned to contact and rest a user's arm and pivotably connected handles provided on each side of a seat, wherein said arm rest members and said handles are provided at lower ends of arms arranged at both sides of said seat, the arms being pivotably suspended at a position at a top of said training machine such that said adjustment device comprises control means for laterally adjusting positions of said arms, said arm rest members, and said handles with regard to said seat, and a control member which can be set in a selected position of a pre-determined number of positions corresponding to the laterally adjusting positions of said arms, said arm rest members, and said handles, wherein said adjustment device further comprises a linkage means at each side of said adjustment device, each of the linkage means being connected at one end thereof to a turnable link member, which is pivotably fastened at its center at a frame portion of the training machine, and at the other end to said arms.

13. An adjustment device for a training machine, especially a triceps extension or a biceps curl, for strengthen training and rehabilitation, having an arm rest member positioned to contact and rest a user's arm and pivotably connected handles provided on each side of a seat, wherein said arm rest members and said handles are provided at lower ends of arms arranged at both sides of said seat, the arms being pivotably suspended at a position at a top of said training machine such that said adjustment device comprises control means for laterally adjusting positions of said arms, said arm rest members, and said handles with regard to said seat, wherein said arms are pivotably attached at the top of a frame portion of the training machine so that said arms, said arm rest members, and said handles are able to be turned laterally with regard to said seat, and wherein said adjustment device further comprises a linkage means at each side of said adjustment device, each of the linkage means being connected at one end thereof to a turnable link member, which is pivotably fastened at its center at a frame portion of the training machine, and at the other end to said arms.

14. An adjustment device for a training machine, especially a triceps extension or a biceps curl, for strengthen training and rehabilitation, having an arm rest member positioned to contact and rest a user's arm and pivotably connected handles provided on each side of a seat, wherein said arm rest members and said handles are provided at lower ends of arms arranged at both sides of said seat, the arms being pivotably suspended at a position at a top of said training machine such that said adjustment device comprises control means for laterally adjusting positions of said arms, said arm rest members, and said handles with regard to said seat, wherein said adjustment device further comprises a linkage means at each side of said adjustment device, each of said linkage means being connected at one end thereof to a turnable link member, which is pivotably fastened at its center at a frame portion of the training machine, and connected at the other end to said arms, and wherein said control means interacts with a scale member attached to the frame of the training machine, such that when turning said control means which is fixed to said central link member a desired position on the scale member can be set.

* * * * *